US005182419A

United States Patent [19]

Burnette

[11] Patent Number: 5,182,419

[45] Date of Patent: Jan. 26, 1993

[54] SABOTED PROJECTILE

[75] Inventor: James E. Burnette, Fullerton, Calif.

[73] Assignee: ASI Systems International, Orange, Calif.

[21] Appl. No.: 830,741

[22] Filed: Feb. 19, 1986

Related U.S. Application Data

[63] Continuation-in-part of Ser. No. 389,686, Jun. 18, 1982, abandoned, which is a continuation-in-part of Ser. No. 338,501, Jan. 6, 1982, abandoned, which is a continuation of Ser. No. 1,076, Jan. 5, 1979, abandoned, which is a continuation-in-part of Ser. No. 909,922, May 26, 1978, abandoned.

[51] Int. Cl.[5] ..... F42B 14/06

[52] U.S. Cl. ..... 102/523

[58] Field of Search ..... 102/517-523, 102/501, 532

[56] References Cited

U.S. PATENT DOCUMENTS

| | | | |
|---|---|---|---|
| 2,382,152 | 8/1945 | Jakobsson | 102/522 |
| 2,423,453 | 7/1947 | Howe . | |
| 2,715,874 | 8/1955 | Hablutzel et al. | 102/523 |
| 2,983,225 | 5/1961 | Walker | 102/522 |
| 3,055,268 | 9/1962 | Rosenthal | 102/522 |
| 3,359,905 | 12/1967 | Engel | 102/522 |
| 3,431,815 | 3/1969 | Kaufmann, Jr. | 102/522 |
| 3,447,466 | 6/1969 | Engel | 102/522 |
| 3,507,221 | 4/1970 | Grolly | 102/523 |
| 3,714,900 | 2/1973 | Feldman . | |
| 3,769,912 | 11/1973 | Friend . | |
| 3,771,458 | 11/1973 | Schweimler et al. | 102/523 |
| 3,862,603 | 1/1975 | Kornblith et al. . | |
| 3,948,184 | 4/1976 | Pierre et al. | 102/522 |
| 4,029,018 | 6/1977 | Bjornson . | |
| 4,164,904 | 8/1979 | Laviolette | 102/529 |
| 4,517,898 | 5/1985 | Davis | 102/517 |

FOREIGN PATENT DOCUMENTS

| | | |
|---|---|---|
| 812680 | 2/1937 | France . |
| 2420116 | 10/1979 | France . |

OTHER PUBLICATIONS

"Free Flight Motion of Symmetric Missiles" by Murphy Report No. 1216 Jul. 1963, Aberdeen Proving Ground, Md.

"Exterior Ballistics of Rockets" Chapter 10, Davis, Follin, and Blitzer. 1958.

"Engineering Design Handbook" Jan. 1976, Recoiless Rifle Weapon Systems.

The Flight of Uncontrolled Rockets by Gantmacher and Levin.

Engineering Design Handbook, Design for Control of Projectile Flight Characteristics Sep. 1966.

Ordinance Engineering Design Handbook, Artillery Ammunitions Series, Section 3, May 1977, Design for Control of Flight Characteristics.

Exterior Ballistics, Shane, Kelly and Reno 1953, Chapter 11.

*Primary Examiner*—Harold J. Tudor

*Attorney, Agent, or Firm*—Robert L. Sassone

[57] ABSTRACT

A saboted projectile comprises a sub-caliber, spin-stabilized warhead (usually an armor-piercing penetrator) and a full caliber spin-stabilized non-disintegrating sabot capable of being fired by airplanes. The sabot releasably receives the armor-piercing penetrator and is adapted to be mounted on a conventional ammunition cartridge. The sabot includes a novel method of holding the penetrator until firing, tightening a reverse threaded end cap against the aft end of the penetrator during firing and utilizing interior end cap geometry to utilize firing gas pressure to accelerate the penetrator forward in relation to the sabot after leaving the gun barrel. Accuracy is increased by maintaining axial symmetry and releasing the penetrator in substantially the same way each time. There are other novel features.

5 Claims, 1 Drawing Sheet

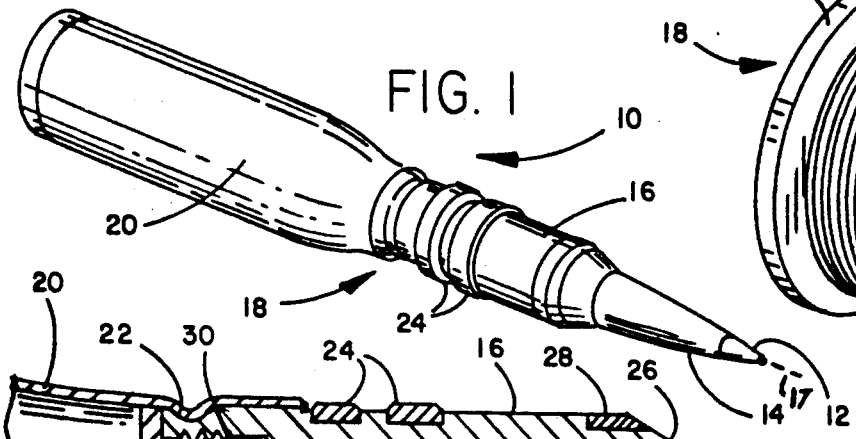
FIG. 1
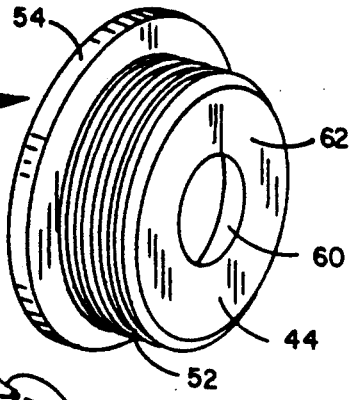
FIG. 4
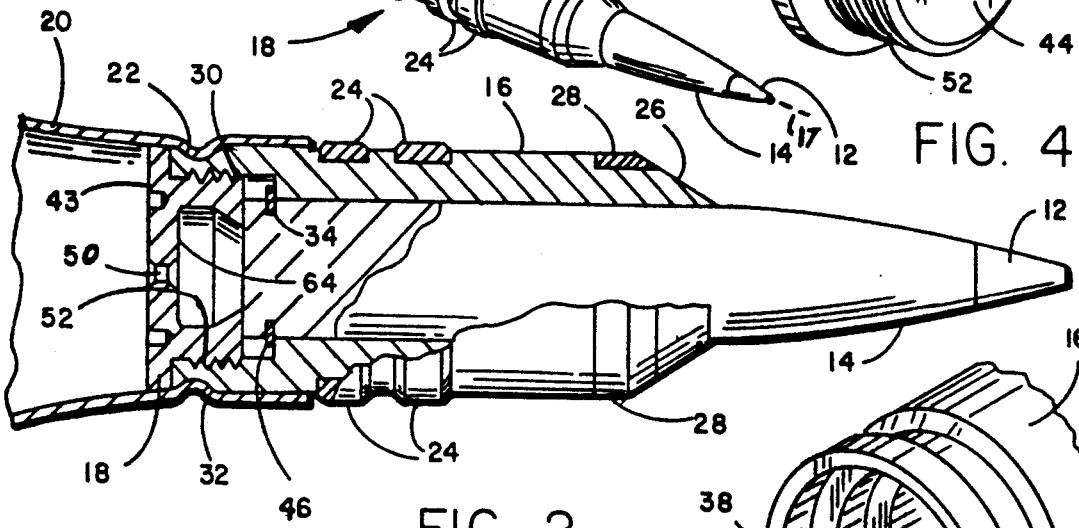
FIG. 2
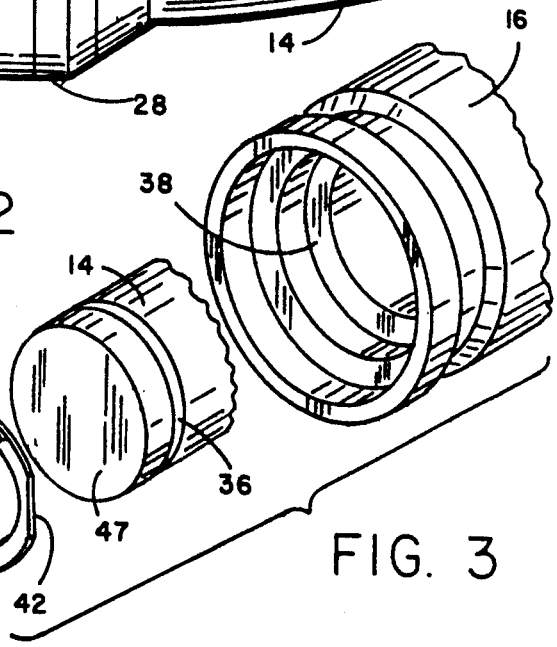
FIG. 3
FIG. 7
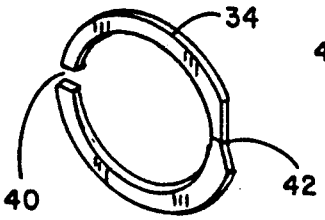
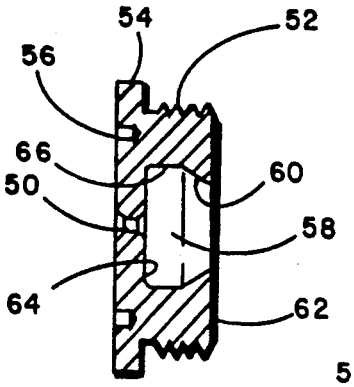
FIG. 6
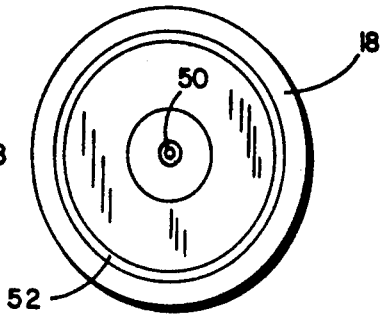
FIG. 5
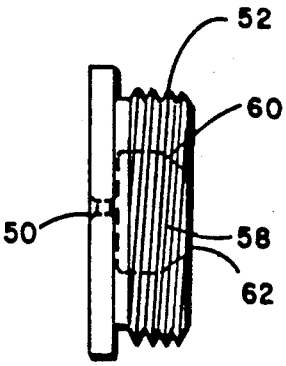
FIG. 6a

SABOTED PROJECTILE

BACKGROUND OF THE INVENTION

1. Field of the Invention

The present invention relates to saboted projectiles capable of being fired from airplanes wherein the sabot does not disintegrate after firing but rather follows a predictable trajectory so that there is no substantial chance of ingestion of the sabot or any part thereof into the airplane engine or collision of the plane with a sabot or any part thereof.

2. Description of the Prior Art

The prior art includes about 1,000 patents relating to saboted projectiles. None of these are capable of being fired from an airplane because none of the prior art discloses a practical saboted projectile having a sabot which after separation from the penetrator describes a predictable trajectory carrying the sabot initially forward of the airplane then downward in relation to the airplane so that the sabot is always below the airplane by the time the airplane catches up with the decelerating sabot. Typically prior art sabots disintegrate which is no problem when fired from a platform not moving at high speeds.

Accordingly, there are no saboted projectiles disclosed by the prior part which are capable of being fired from an airplane. Modern guns may fire 100 projectiles per second. If 100 sabots per second disintegrate in front of an airplane, the particles from the sabots move in relatively random directions within a relatively wide cone in front of the plane. There is a substantial chance that one or more of these articles will collide with the plane or be ingested into the plane's engine. Accordingly, prior art sabots are too hazardous to the airplane to be fired from the plane.

A saboted projectile comprises a sub-caliber penetrator relatively dense in relation to cross-sectional area projectile which must be separated from a low mass, low density, in relation to cross-sectional area, sabot after leaving the gun barrel. The shape of the unseparated sabot/penetrator combination is not one that one would normally use for accuracy. In addition, there are relatively minor but inherent problems associated with accuracy which result from separation of the sabot from the penetrator. The quicker the penetrator separates from the sabot and the less mechanical contact between the sabot and the penetrator during separation and the more uniform the separation point of the sabot from the penetrator is in relation to the muzzle during firing, the more accurate is the penetrator likely to be. Doing the same thing the same way each time is a good strategy for maintaining accuracy and precision. If a sabot is to be assembled by screwing in a threaded end plate, a procedure which is useful for manufacturing purposes, there is a chance that the threading may become slightly loosened during storage or loading of the projectile. Loading may subject the projectile to forces in excess of 2,000 g's which could loosen or change the tightness of a screwed in part. Accordingly, accuracy would be increased if there were someway to ensure uniform tightening of the threads before the projectile leaves the barrel but after it is fired.

Practically none of the elements claimed in the present invention are found in the prior arts. A search of the appropriate classes found a ring used, which ring had a slit and a notch at the opposite end to make expansion of the ring easier, but the ring was not actually balanced when rotated so as to expand the prior art ring and unbalanced when not rotated at high rotational velocity. The prior art discloses no sabot capable of being fired from an airplane in a forward direction, without danger to the airplane from possible ingestion of a part of the sabot. The prior art discloses no sabot capable of following a predictable trajectory guaranteed to keep the sabot away from a strafing airplane which must remain within 150 feet of the terrain to avoid return fire. The prior art discloses no sabot capable of remaining ahead of the airplane for 4 to 5 seconds at airplane speeds of about 300 knots and 2 to 3 seconds at airplane velocity of 500 knots, thereby insuring that the sabot will be very close to the ground when the plane catches up to the sabot. The prior art discloses no such sabot substantially maintaining its shape between leaving the barrel and separating from the penetrator and impact.

SUMMARY OF THE INVENTION

The present invention comprises a projectile adapted to be received by a conventional ammunition cartridge for firing from a gun having a barrel. The projectile comprises an axially symmetric penetrator having a forward end defining a streamlined wind screen and an aft exterior surface defining a circular cylinder of uniform diameter except for a ring groove defined by the exterior surface near but not at the aft end of the penetrator.

The projectile further comprises an armored generally axially symmetrical three piece sabot. The first piece of the sabot is an axially symmetrical forward section having sub parts. The forward section defines an interior circular cylindrical surface slightly greater in diameter than the exterior surface of the circular cylinder of the penetrator. The exterior surface of the forward section increases as a function of distance from the forward end of the forward section to a strong bourrelet or equivalent capable of preventing wearing away of sabot material which wearing away would cause balloting (wobbling) in the barrel. The exterior surface of the sabot defines at least one portion of greater diameter capable of mating with grooves of a gun barrel to prevent loss of a substantial amount of gas around the sabot during firing. The portion of greater diameter is fabricated from a material softer than rifling so that said soft portion of greater diameter can be engraved by the grooves of a gun barrel without damaging the rifling grooves. The softer portion may be fabricated from plastic or materials known to the prior art such as brass, bronze, or certain types of iron as well as plastic. The aft portion of the forward portion of the sabot has an exterior surface with at least one indentation capable of removably mating with the forward portion of the casing of a conventional ammunition cartridge. The forward interior surface of the axially symmetric forward section of the sabot adjacent that portion of the penetrator forward of the penetrator ring groove defines an interior circular cylinder of diameter slightly greater than the diameter of the penetrator.

The second piece of the sabot comprises an expandable ring of interior diameter when not expanded slightly greater than the diameter of the penetrator ring groove and an exterior diameter greater than the diameter of the penetrator. The ring has an interior diameter when expanded slightly greater than the exterior diameter of the penetrator. The purpose of the ring is to retain the penetrator within the sabot until centrifugal force causes the ring to expand allowing the penetrator to separate from the sabot. While a ring/groove arrangement is described and claimed herein, the arrangement described and claimed is the equivalent of other prior art methods such as shear pins or spring loaded balls.

The third piece of the sabot is an armored end cap coupled to the aft end of the forward section to hold the sabot and penetrator together prior to firing. The forward portion of end cap is threaded to mate with the aft portion of the forward section of the sabot. The end cap comprises a cavity referred to as a plenum chamber to store gun gas pressure to be used later to force the separation of the penetrator from the sabot. The gun chamber pressure is transferred to the plenum chamber through a small orifice at the aft portion of the end cap.

The sabot has a geometry and mass distribution such that its actual gyroscopic stability factor is equal to or greater than that required for achieving stable flight along a substantially predictable and repeatable trajectory. The ring expands and permits and penetrator to separate from the sabot during rotation in a rifled barrel during firing. The penetrator does not actually separate from the sabot in the barrel because the sabot is still being accelerated and pushed against the aft end of the penetrator. The penetrator separates from the sabot after leaving the barrel when the force of acceleration on the sabot from firing diminishes sufficiently to permit the non-disintegrating sabot to decelerate backwards relative to the penetrator due to the expanding gas in the plenum chamber. The sabot geometry and mass distribution are such that the roll moment of inertia is optimized such that it is greater than that required for stable flight by increasing the amount of mass located near the circumference of said sabot. In a typical example, the forward end of the projectile comprises a streamlined wind screen which increased in diameter as a function of distance from the forward end until reaching maximum diameter of the penetrator which point on the penetrator coincides with the forward edge of the sabot which increases in diameter to the bourrelet equivalent which in the present example comprises a steel bourrelet in a ring-like shape at the forward edge of the generally cylindrical part of the exterior surface of the projectile. The bourrelet is relatively dense compared to the rest of the sabot and is disposed generally forward and at the outside periphery compared to the rest of the sabot thereby assisting in causing stable flight by increasing the amount of mass near the circumference of said sabot, Additionally, the sabot stability is increased by the bourrelet placement forward of the sabot longitudinal center-of-gravity.

In one example, the ring is split along a radius at one part of the ring's periphery and at the opposite part of the ring's periphery about 180 degrees removed from the split, material is removed from the periphery of the ring outside a chord in sufficient quantity such that the amount of mass removed at the chord is sufficient so that the ring is balanced when the sabot spins at about the rotational velocity of sabot spinning at exit from the barrel and the ring has been expanded.

The aft portion of the interior surface of the forward section of the sabot has an interior diameter such that expansion of the ring causes the periphery of the ring not outside the chord to become substantially adjacent the interior surface of the aft portion of the forward section of the sabot by flexing of the ring at the chord and the interior diameter of the ring increases in size to be slightly greater than the exterior diameter of the penetrator thereby releasing the penetrator from the ring before the sabot is midway along the rifling in the barrel. The penetrator, however, is coupled to the forward end of the end cap by acceleration of the sabot by the firing of the projectile until after the sabot stops accelerating by leaving the muzzle.

The penetrator is separated from the sabot primarily by pressure from gas forced into a cavity defined by the interior surface of the end cap, which as is forced into said cavity, during the first ¼ of travel by the sabot along the length of the interior of the barrel.

The aft surface of the penetrator defines a plane perpendicular to the axis. The forward surface of the end cap adjacent the aft surface of the penetrator defines a plane, except for the material removed to form the cavity, which end cap planar surface is parallel to and adjacent to the planar aft surface of the penetrator. The cavity of the end cap comprises a tiny axial hole through the aft end of the end cap to a larger cavity shaped to maximize volume while substantially minimizing reduction in strength of the end cap forward surface by removal of material to form the cavity.

The aft portion of the end cap comprises a relatively thin strong material such as steel. The diameter of the steel is about equal to the diameter of the bourrelet and prevents balloting in much the same manner as the bourrelet. The tiny axial hole defined by the interior surface of the end cap should be slightly less than 5% of the diameter of the end cap to permit gas to flow in immediately after the propellant ignition in the cartridge and to permit gas to flow back out after pressure in the cavity exceeds pressure in the gun barrel, only at a very slow rate so that pressure in the cavity is maintained long enough to force the separation of the penetrator from the sabot outside the muzzle.

The pressure in the end cap exerts a forward force on the aft planar surface of the penetrator capable of accelerating at a rate sufficiently great to increase the velocity of the penetrator by about fifty feet per second and said pressure exerts a decelerating force on the forward surface of the end cap sufficiently great to reduce the velocity of the sabot by about 150 feet per second. The size of the cavity and the maximum gas pressure of about 40,000 psi developed in the cavity is selected to minimize separation time of penetrator from sabot without imparting oscillation to the penetrator and without weakening any part of the sabot sufficiently so that sabot shape changes during firing could effect accuracy. All components of the projectile must be strong enough to withstand forces in excess of 2,000 g's in random directions prior to firing and in excess of 100,000 g's parallel to the axis during firing.

The loading forces might unthread a sabot slightly, thereby reducing accuracy. In the present example, rotation of the projectile before the projectile leaves the barrel but after the projectile is fired insures uniform tightening of the left-hand threads coupling the end cap to the forward section of the sabot. This holds true so long as the sabot is accelerated by the firing. The aerodynamic shape of the sabot is such that after release from the penetrator, the velocity and deceleration of the sabot are such that the sabot remains in front of an airplane flying about 300 knots for 4 to 5 seconds and in front of an airplane flying at 500 knots 2 to 3 seconds and the sabot does not significantly change shape prior to impact.

The amount of mass located near the circumference of said sabot and near the forward end of the sabot is increased by utilizing a steel bourrelet at the periphery of the sabot near the front of the sabot. The bourrelet is more dense than the average density of the sabot. After separation, the ring remains inside the aft end of the sabot.

DRAWING DESCRIPTION

Reference should be made at this time to the following detailed description which should be read in conjunction with the following drawings, of which:

FIG. 1 illustrates a projectile according to the present invention coupled to a cartridge case;

FIG. 2 is a partially cut away side view of the invention of FIG. 1;

FIG. 3 is a ¾ view of the ring release mechanism of the present invention;

FIG. 4 is a ¾ view of the end cap of a sabot according to the present invention;

FIG. 5 is another view of the end cap;

FIG. 6 is a partially cut away view of the end cap;

FIG. 6*a* is a side view of the end cap; and

FIG. 7 shows the expanded ring.

DETAILED DESCRIPTION

Reference should be made at this time to each of the drawings. The theoretical basis of the present invention is as follows: Stable flight as applied to projectiles is defined as the tendency for the projectile axis of symmetry to return to the flight path direction after any perturbation from the flight path. In other words, if the projectile axis of symmetry is angularly displaced from the flight path vector due to external forces and/or moments from any source, the resultant angularity of the projectile will decrease or damp out and tend toward zero. Conversely, an unstable projectile's axis of symmetry, after angular perturbation from the flight path vector, will experience an increasingly greater deviation from the flight path vector. The ultimate condition is a tumbling action wherein the projectile experiences random lift forces, ultimately resulting in an unrepeatable and unpredictable trajectory.

The necessary and sufficient conditions for projectile flight stability can be expressed by the following equations:

$$S_a = \frac{w^2 I_{XX}^2}{4 I_{YY} M_a} \geqq S_r \tag{1}$$

$$M_a = \tfrac{1}{2}\, pAV^2 d\, C_{Ma} \tag{2}$$

$$S_r = \frac{1}{S_d(2 - S_d)} \tag{3}$$

$$S_d = \frac{2\left(C_{Na} - C_D + \frac{md^2}{2I_{XX}} C_{Npa}\right)}{C_{Na} - C_D - \frac{md^2}{2I_{YY}}(C_{Mq} + C_{Ma}) + \frac{md^2}{2I_{XX}} C_{lp}} \tag{4}$$

$S_a$ is the actual projectile (or, in this case, sabot) gyroscopic stability factor (non-dimension), $M_a$ is the sabot pitch moment slop (in foot-pounds/radian), $S_r$ is the required gyroscopic stability factor (non-dimensional), and $S_d$ is the sabot dynamic stability factor (non-dimensional).

In order to achieve stable flight, the actual stability factor ($S_a$) of the sabot must be equal to or greater than the required gyroscopic stability factor ($S_r$) of the sabot. In the above analysis, Equation (1) is used in conjunction with Equation (2) to determine the sabot's actual gyroscopic stability factor, and Equation (3) is used in conjunction with Equation (4) to determine the required gyroscopic stability factor.

The parameters necessary to solve these equations are as follows:

Sabot Aerodynamic Parameters $C_D$=Drag coefficient (non-dimensional)

$C_{lp}$=Roll damping coefficient (non-dimensional)

$(C_{Mq}+C_{M\dot{\alpha}})$=Pitch (yaw) damping coefficient (non-dimensional)

$C_{NPa}$=Magnus moment coefficient (non-dimensional)

$C_{Na}$=Normal force slope coefficient (non-dimensional)

$C_{Ma}$=Pitching moment coefficient (non-dimensional)

Sabot Mass Parameters d=Diameter (feet)

A=Cross-sectional area (feet$^2$)

$I_{XX}$=Roll moment of inertia (slug-feet$^2$)

$I_{YY}$=Pitch (yaw) moment of inertia (slug-feet$^2$)

m=Mass (slugs)

Gun Parameters w=Spin rate (radians/second)

V=Velocity (feet/second)

P=Air density (slugs/feet$^3$)

The sabot mass parameters listed above are directly calculated from the geometry of the sabot itself. As will be discussed below, the geometry and mass distribution of the sabot is configured so as to result in mass parameters which satisfy Equations (1) through (4) above, in order to achieve stable flight. These mass parameters in turn affect the aerodynamic parameters listed above. An important feature of the present invention is the manner in which the geometry of the sabot achieves mass and aerodynamic parameters which result in a satisfactory solution to Equations (1) through (4), and therefore provide spin-stabilized sabot flight.

However, for an unconventional shape, such as the present sabot, the aerodynamic parameters cannot be directly calculated. In order to obtain values for these parameters, a sabot having a particular geometry must first be aerodynamically tested in a free flight aeroballistic research facility. In such a facility, the trajectory of the sabot is carefully measured, and then used to obtain these aerodynamic parameters. Normally, for conventionally shaped projectiles, these parameters can be directly calculated and then used to determine, or in effect predict, the trajectory of the projectile. Such free flight aerodynamic tests are described in more detail in *Description and Capabilities of the Aeroballistic Research Facility*, February 1978 (Air Force Armament Laboratory, AFATL-TR-78-41).

Once all of the above parameters are determined, by calculation or testing, the stability of sabot flight can be determined according to Equations (1) through (4). If these equations are satisfied, the sabot will experience stable flight along a repeatable and predictable trajectory.

From Equations (1) and (3), it can be seen that the chances of achieving the sabot stability will be enhanced where $S_a$ is maximized so as to be greater than $S_r$. $S_a$ can be maximized by optimizing the roll moment of inertia ($I_{xx}$) which is a squared factor in the numerator of Equation (1). Thus, an important feature of the present invention is the optimization of the roll moment of inertia by increasing the amount of mass at the periphery or circumference of the sabot. In one embodiment this optimization is accomplished by enlarging or maximizing the size or mass of the sabot. In one embodiment, this optimization is accomplished by enlarging or maximizing the size or mass of the steel bourrelet 28 within the bounds of other design limitations. At the same time, changes in the size of the bourrelet 28 also serve to decrease the the pitching moment coefficient ($C_{Ma}$) which in turn maximizes $S_a$. The pitching moment coefficient is decreased since a longer or thicker bourrelet 28 causes the center of gravity of the sabot to move forward, thereby decreasing the distance between the center of gravity of the sabot and its center of pressure resulting in a decreased value for the pitching moment coefficient.

$S_a$ can also be maximized by minimizing the pitch moment of inertia ($I_{YY}$). This is accomplished by minimizing the length of the sabot. However, this design parameter is subject to the limitation that the sabot cannot be shortened to the extent that the center of gravity of the penetrator is positioned forward of the full caliber leading edge of the sabot. Such a positioning could produce a catastrophic penetrator bending or fracture if there is any mass unbalance in the cantilevered penetrator. Thus, preferably, the pitch moment of inertia is minimized to the extent that the center of gravity of the penetrator is positioned within the forward and rear extremes of the annulus formed by the bourrelet of the sabot. This positioning will provide stability to the penetrator and minimization of the pitch moment of inertia.

Furthermore, it is advantageous to provide the sabot with a shallow bevel on its leading edge in order to reduce the effect of drag forces acting on the sabot. However, this parameter is also subject to the limitation that the bevel should not permit the center of gravity of the penetrator to be forward of the bourrelet or full-caliber, leading peripheral edge of the sabot. Furthermore, in order to reduce balloting in the gun barrel, it is desirable to provide a sabot approximately two calibers in length, which length is in turn minimized according to the above parameters.

It should also be pointed out that the most critical time of the sabot's flight, at least with respect to its stability, is at the exit of the gun barrel. At this location, the velocity of the sabot is greatest. The velocity is a squared factor in the equation for the pitch moment slope ($M_a$), and therefore tends to maximize that parameter and to minimize $S_a$. Thereafter, the velocity of the sabot decreases sharply due to the effect of drag, thereby increasing $S_a$ and enhancing the stability of the sabot. Thus, if the sabot achieves stability at the gun barrel exit, it will also demonstrate stable flight during the remainder of its trajectory since the spin rate (w) decreases slowly with time.

Another feature which reduces the effective drag forces acting on the sabot is the orifice in the end cap. This orifice provides an entrance for propellant gases into the plenum chamber, and also permits air to flow through the sabot after separation of the penetrator, thereby reducing the sabot base drag and the total drag acting on the sabot. Thus, the ability of the sabot to follow a flight path which outruns the aircraft is enhanced.

To reiterate, just because a projectile, or sabot, is spinning upon egress from the gun barrel, does not mean that the projectile will experience stable flight. In addition, the aerodynamic and mass parameters of the sabot must be such that Equations (1) through (4) are satisfied. The probability of all of these parameter values being unintentionally in the proper relationship for stability and especially for the unconventional sabot shape, is very slight.

Sabots constructed according to the principles set forth above have been tested and found to be stable and to travel in predictable and repeatable trajectories. Typical aerodynamic and mass parameter values for a 30 mm, single piece, spin-stabilized sabot, are listed below for a Mach number of 4.0.

$$C_D = 0.860$$
$$C_{l_p} = -0.008$$
$$(C_{M_q} + C_{M_{\dot{\alpha}}}) = -3.196$$
$$C_{N_{pa}} = 0.032$$
$$C_{N_a} = 2.972$$
$$d = 0.0984 \text{ feet}$$
$$I_{XX} = 7.8717 \times 10^{-6} \text{ slug-feet}^2$$
$$I_{YY} = 2.5615 \times 10^{-5} \text{ slug-feet}^2$$
$$m = 5.5853 \times 10^{-3} \text{ slugs}$$

Substituting these values into Equation (4) yields a dynamic stability factor of 0.814. Substituting this value into Equation (3) yields a required gyroscopic stability factor ($S_r$) of 1.036. Furthermore, typical values for the parameters of Equations (1) and (2) are as follows.

$$A = 7.6072 \times 10^{-3} \text{ feet}^2$$
$$C_{M_a} = 4.127$$
$$V = 4468 \text{ feet/second}$$
$$W = 13747 \text{ radians/second}$$
$$P = 2.378 \times 10^{-3} \text{ slugs/feet}^3$$

Substituting the above values into Equation (2) yields a pitching moment coefficient of 73.327 feet-pounds/-radian. Substituting this value into Equation (1) yields an actual gyroscopic stability factor ($S_a$) of 1.559. Thus $S_a$ is greater than $S_r$. Accordingly, a sabot exhibiting the above parameters will experience stable flight.

Sabot flight stability in turn results in repeatability and predictability in trajectory. Thus, a typical trajectory enables the sabot to carry over friendly ground troops and personnel in the case of ground-fired sabot projectiles. Furthermore, in the case of aircraft-fired projectiles, the sabot will outrun the aircraft, at least until it has fallen so far below the flight path of the aircraft, so as to totally preclude engine ingestion. For example, calculations show that in a 4000 foot range, with an aircraft flight path angle of −5 degrees and velocity of 333 knots true airspeed, the sabot of the present invention followed a safe trajectory which enabled it to strike the ground after 4 seconds at a distance of about 2250 feet from the point of firing while the firing aircraft was at an altitude of over 150 feet. In addition, 1 second after firing, the sabot preceded the aircraft by about 800 feet; 2 seconds after firing, the precedence was about 600 feet; and at 3 seconds, about 400 feet. However, as the precedence decreased, the flight path of the sabot was falling safely below the flight path of the aircraft, as just pointed out.

A projectile 10 as best shown in FIG. 1 is adapted to be received by a conventional ammunition cartridge case 20 for firing from a gun (not shown), having a barrel (not shown) with rifled interior surface (not shown).

The projectile comprises an axially symmetric penetrator 14 having a forward end 12 defining a streamlined wind screen 12 and an aft portion comprising the majority of the length of the penetrator defining a circular cylinder of uniform diameter except for a ring groove 36 defined by the exterior surface near but not at the aft end 47 of the penetrator 14.

An armored generally axially symmetrical three piece non-disintegrating sabot 18 comprising as the first piece 16 an axially symmetrical forward section 16 defining an interior circular cylindrical surface 38 slightly greater in diameter than the exterior surface of the circular cylinder of the aft portion f the penetrator 14. The exterior surface of the forward section 16 of the sabot 18 increases as a function of distance from the forward end 26 of the forward section 16 to a strong bourrelet equivalent 28 or bourrelet 28 capable of preventing wearing away of sabot 18 material which wearing away would cause balloting in the barrel. The exterior surface of the sabot 18 defines at least one portion 24 of greater diameter which may be called a rotating band 24 which band 24 is capable of mating with grooves of a gun barrel to prevent loss of a substantial amount of gas around the sabot 18 during firing. The portion of greater diameter 24 is fabricated from a material softer than the gun barrel rifling so that said soft portion 24 of greater diameter can be engraved by the grooves of the gun barrel without damaging the rifling grooves. The aft portion 46 of the forward section 16 of the sabot 18 as an exterior surface with at least one indentation 32 capable of removably mating with the forward portion 22 of the casing 20 of a conventional ammunition cartridge, the forward interior surface 38 of the axially symmetric forward section 16 of the sabot 18 adjacent that portion of the penetrator forward of the penetrator ring groove 36 defines an interior circular cylinder 38 of diameter slightly greater than the diameter of the penetrator 14.

The second piece 34 of the sabot comprises an expandable ring 34 of exterior diameter when not expanded slightly greater than the diameter of the penetrator 14, and an interior diameter when expanded slightly greater than the exterior diameter of the penetrator 14. The interior diameter of the ring 34 when expanded is substantially equal to the exterior diameter of the ring 34 when not expanded.

The third piece 64 of the sabot 18 is an armored end cap 64 coupled to the aft end of the forward section 16 to hold the sabot 18 and penetrator 14 together prior to firing. The aft end 30 of the forward section 16 has an interior surface approximately to but slightly greater than the exterior surface of the expanded ring in diameter and capable of coupling to the end cap 64.

The sabot 18 has a geometry and mass distribution such that its actual gyroscopic stability factor is equal to or greater than that required for achieving stable flight along a substantially predictable and repeatable trajectory.

The ring 34 expands and permits the penetrator 14 to separate from the sabot 18 during rotation in a rifled barrel during firing so that the penetrator 14 separates from the sabot 18 after leaving the barrel when the force of acceleration on the sabot 18 from firing diminishes sufficiently to permit the non-disintegrating sabot 18 to decelerate backwards from the relative position of the penetrator 14, wherein the sabot 18 does not disintegrate near the gun muzzle. In fact, the sabot 18 does not disintegrate at all unless one could apply that term to the sabot when describing the damage done to the sabot 18 on impact.

The sabot 18 geometry and mass distribution are such that the roll moment of inertia is optimized such that it is greater than that required for stable flight, by increasing the amount of mass located near the circumference of said sabot 18.

The ring 34 is split along a split 40 along a radius at one part of the ring's 34 periphery and at the opposite part of the ring's periphery about 180 degrees removed from the split 40, material is removed from the periphery of the ring 34 outside a chord 42 in sufficient quantity such that that portion of the ring 34 is weakened so that when expanded the ring 34 bends at the chord 42. The amount of mass removed at the chord 42 (outside the chord 42) is sufficient so that the ring 34 is balanced about its axis only when the sabot 18 spins at about the rotational velocity of sabot 18 spinning at exit from the barrel and the ring 34 has been expanded.

The aft portion 30 of the forward section 16 of the sabot 18 has an interior diameter slightly greater than the exterior diameter of the expanded ring 34 such that expansion of the ring 34 causes the periphery of the ring 34 not outside the chord 42 to become substantially adjacent the interior surface 30 of the aft portion 46 of the forward section 16 of the sabot 18 by flexing of the ring 34 at the chord 42 as shown in FIG. 7. The interior diameter of the ring 34 increases in size to be slightly greater than the exterior diameter of the penetrator 14 thereby releasing the penetrator 14 from the ring 34 before the sabot 18 is midway along the rifling in the barrel (not shown) during firing. The penetrator 14 is coupled to the forward end 44 of the end cap 62 by acceleration of the sabot 18 by the firing of the projectile until after the sabot 18 almost stops accelerating outside the barrel. While the sabot 18 is in the barrel, acceleration of the sabot 18 is so great that the forward portion 44 of the end cap 62 is pressed tightly against the aft surface 47 of the penetrator 14 causing the penetrator 14 to rotate at the same velocity as the end cap 62. When the projectile 10 leaves the barrel, it initially is still slightly accelerated by the expanding gas bubble flowing out of the barrel, but acceleration of the sabot quickly reduces to zero then becomes negative after exit of the sabot 18 from the barrel.

The penetrator 14 is separated from the sabot 18 end cap surface 44 primarily by pressure from gas forced into a cavity 58 best shown on FIG. 6. The cavity 58 is defined by the interior surface of the end cap 62. The gas from the fired cartridge 20 also called cartridge case 20 is forced into said cavity 58 during the first ¼ of travel by the sabot 18 along the length of the interior of the barrel after propellant ignition in the cartridge. Pressure inside the cavity 58 exceeds 40,000 psi, then diminishes as the sabot 18 travels down the barrel to in excess of 10,000 psi as the sabot 18 leaves the barrel. Pressure of the gas from the cartridge accelerating the projectile 10 is initially greater than pressure inside the cavity 58 causing pressure inside the barrel force gas into the cavity 58 via axial cavity hole 50. The hole 50 is tiny, but initial pressure is so great pressure inside cavity 58 builds up to more than 40,000 psi very quickly. The tiny hole 50 permits gas to exit cavity 58 as soon as pressure inside the barrel becomes less than pressure inside the cavity 58, but the pressure difference is not great so that after exit from the barrel pressure inside the cavity still exceeds 10,000 psi, enough to separate penetrator aft end surface 47 from end cap 62 forward end surface 44 while sabot 18 is still accelerating when the acceleration of sabot 18 diminishes so that it can be overcome by the pressure inside cavity 58.

The aft surface 47 of the penetrator 14 defines a plane perpendicular to the axis 17 about which the penetrator 14 and forward section 16 of the sabot 18 are disposed and the forward surface 44 of the end cap 62 adjacent the aft surface 47 of the penetrator 14 defines a plane, except for the material removed to form the cavity 58. The end cap planar surface 44 is parallel to and adjacent to the planar aft surface 47 of the penetrator 14 until separation. The cavity 58 of the end cap 62 comprises two parts, the first the tiny axial hole 50 through the aft end 64 of the end cap 62. The hole 50 couples to a larger cavity 66 shaped to maximize volume while substantially minimizing reduction in strength of the end cap forward surface 44 by removal of material to form the cavity 58.

The aft portion 64 of the end cap 62 comprises a relatively thin strong material such as steel. In a first example, the tiny axial hole is slightly less than 5%, about 4%, of the diameter of the end cap 62 at the aft end 64 of the end cap 62. The part of the cavity 58 communicating with the hole 50 averages about half the diameter of the forward part 52 of the end cap 62 and has the shape of a circular cylinder near the aft end of the part of the cavity 58 communicating with the hole 50 and the shape of a truncated cone 60 diminishing to a diameter about ⅓ the diameter of the forward part 52 of The end cap 62 at the opening of the cavity 58 the forward surface 44 of the end cap 62. The end cap 62 is substantially less than its radius in length, and the forward exterior approximately 60% of the periphery of the end cap 62 comprises left-hand male threads 52 mating with left-hand female threads 30 formed by the aft interior surface 30 of the forward section 16 of the sabot 18. Acceleration of the sabot 18 causes the sabot 18 to spin in a direction determined by the rifling of the parallel such that the end cap is tightened as a function of angular acceleration imparted by the rifling of the barrel such that the forward surface of the end cap is fixedly temporarily because of acceleration but removably when acceleration diminishes coupled against the aft surface 47 of the penetrator 14 causing the penetrator 14 to rotate at the same rotational velocity as the end cap 62 during acceleration of the projectile 10.

As previously explained, gas from the cartridge case 20 flows into the end cap cavity 58 during the approximately first ¼ of the travel of the projectile 10 down (out of ) the barrel and flows outward from the cavity 58 at a low rate thereafter through the tiny axial hole 50. Accordingly, pressure inside the cavity exceeds pressure in the gun barrel thereafter between the approximately first quarter of the travel of the projectile 10 down the barrel until the penetrator 14 slash sabot 18 comprising the projectile 10 exits the gun barrel.

As soon as pressure inside the cavity 58 exceeds pressure outside but adjacent the tiny hole 50, the size of the tiny hole slows dissipation of pressure in the cavity 58 which pressure exerts a forward force on the aft planar surface 47 of the penetrator 14. This force is capable of and does accelerate the penetrator 14 sufficient to increase the velocity of the penetrator by about 50 feet per second in addition to the acceleration given the projectile by pressure from gas expanding from the cartridge case 20. Said pressure exerts a decelerating force on the forward surface of the end cap 18 sufficiently great to reduce the velocity of the sabot 18 by about 150 feet per second because of the ratio of weights of the penetrator 14 and sabot 18. Said cavity 58 pressure causes the penetrator 14 to be moving out of the sabot 18 while the projectile 10 is still within the gas bubble flowing out of the muzzle and is still being accelerated. The size of the cavity 58 and the gas pressure of about 40,000 psi initially developed and reduced to about 10,000 psi at separation is selected to minimize separation time of penetrator 14 from sabot 18 without imparting oscillation to the penetrator 14 or sabot 18. In addition, the pressure is utilize without weakening any part of the sabot 18 sufficiently so that sabot 18 shape changes during firing could affect accuracy. All components of the projectile 10 are strong enough to withstand forces in excess of 2,000 g's (gs) in random direction prior to firing during the loading process and in excess of 100,000 g's parallel to the axis during firing.

There are manufacturing advantages in threading the end plates 62 to the forward section 16. The severe loading forces, however, might unthread a sabot 18 slightly, thereby reducing accuracy. In the present example, rotation of the projectile 10 before the projectile 10 leaves the barrel but after the projectile 10 is fired insures uniform tightening of the left-hand threads 30, 52 coupling the end cap 62 to the forward section 16 of the sabot 18. This holds true so long as the sabot 18 is accelerated by the firing of the projectile 10 which should occur in each case, barring manufacturing defects The aerodynamic shape of the sabot 18 is such that after release from the penetrator 14, the velocity and deceleration of the sabot 18 are such that the sabot remains in front of an airplane flying about 300 knots for 4 to 5 seconds and in front of an airplane flying at 500 knots 2 to 3 seconds. The sabot does not significantly change shape prior to impact.

A particular example of the invention has been disclosed. Other examples will be obvious to those skilled in the prior art. The invention is limited only by the following claims.

I claim:

1. A projectile for a conventional ammunition cartridge for firing from a gun having a barrel with a rifled interior surface, said projectile comprising:

an axially symmetric penetrator having a forward end defining a streamlined wind screen and an aft portion defining a circular cylinder of uniform diameter except for a ring groove defined ban exterior surface of the penetrator near but not at the aft end of the penetrator around which an expandable ring is coupled to prevent the penetrator prior to ring expansion from moving either aft or forward in relation to an armored generally axially symmetrical three piece non-disintegrating sabot comprising as the first piece an axially symmetrical forward section defining an interior circular cylindrical surface slightly greater in diameter than the exterior surface of the circular cylinder of the aft portion of the penetrator, the exterior surface of the forward section increasing in diameter as a function of distance from the forward end of the forward section to a strong bourrelet which prevents wearing away of sabot material which wearing away would cause balloting in the barrel, the exterior surface of the first piece defining at least one portion of greater diameter which mates with grooves of a gun barrel to prevent loss of a substantial amount of gas around the sabot during firing, the portion of greater diameter being fabricated from a material softer than the gun barrel rifling so that said soft portion of greater diameter can be engraved by the grooves of the gun barrel without damaging the rifling grooves, the aft portion of the first piece of the sabot having an exterior surface with at least one indentation capable of removably mating with the forward portion of the casing of a conventional ammunition cartridge, the forward interior surface of the axially symmetrical first piece of the sabot adjacent that portion of the penetrator forward of the penetrator ring groove defining an interior circular cylinder of diameter slightly greater than the diameter of the penetrator, the second piece of the sabot comprising the expandable ring of exterior diameter when not expanded slightly greater than the diameter of the penetrator, and an interior diameter when expanded slightly greater than the exterior diameter of the penetrator and the third piece of the sabot is an armored threaded end cap attached to a rear portion of the first piece by a threaded connection, said end cap having a forward part and an aft part and an interior surface defining an axially symmetrical cylindrical cavity, the cavity opening via an axially symmetrical hole having a smaller diameter than the cylindrical cavity to a rear surface of the end cap and the forward part having an exterior surface defining left threading thereon which is coupled to the aft end of the first piece which has an interior surface defining left handed threading mating with the threading of the end cap to hold the sabot and penetrator together prior to firing, the aft end of the first piece having an interior surface approximately equal to but slightly greater than the exterior surface of the expanded ring in diameter and coupled to the end cap, the cylindrical cavity in the end cap is in contact with the rear end of the projectile, the sabot having a geometry and mass distribution such that its actual gyroscopic stability factor is equal to or greater than that required for achieving stable flight along a substantially predictable and repeatable trajectory, the ring expanding and permitting the penetrator to separate from the sabot during rotation in a rifled barrel during firing so that the penetrator separates from the sabot after leaving the barrel when the force of acceleration on the sabot from firing diminishes sufficiently to permit the non-disintegrating sabot to decelerate backwards from the relative position of the penetrator, wherein the sabot does not disintegrate near the gun muzzle.

2. The invention of claim 1 wherein the ring is split along a radius at one part of the ring's periphery and at the opposite part of the ring's periphery about 180 degree removed from the split, material is removed from the periphery of the ring outside a chord in sufficient quantity such that that portion is weakened so that when expanded the ring bends at the chord, and the amount of mass removed at the chord is sufficient so that the ring is substantially balanced about its axis when the sabot spins at about the rotational velocity of sabot spinning at exit from the barrel and the ring has been expanded.

3. The invention of claim 2 wherein the aft portion of the interior surface of the forward section of the sabot has an interior diameter such that expansion of the ring causes the periphery of the ring not outside the chord to become substantially adjacent the interior surface of the aft portion of the forward section of the sabot by flexing of the ring at the chord and the interior diameter of the ring increases in size to be slightly greater than the exterior diameter of the penetrator thereby releasing the penetrator from the ring before the sabot is midway along the rifling in the barrel during firing, but the penetrator is coupled to the forward end of the end cap by acceleration of the sabot by the firing of the projectile until after the sabot almost stops accelerating outside the barrel.

4. The invention of claim 3 wherein the aft surface of the penetrator defines a plane perpendicular to the axis and the forward surface of the end cap adjacent the aft surface of the penetrator defines a plane, except for the material removed to form the cavity, which end cap planar surface is parallel to and adjacent to the planar aft surface of the penetrator, the cavity of the end cap comprises the symmetrical hole through the aft end of the end cap to a larger part of the cavity shaped to maximize volume while substantially minimizing reduction in strength of the end cap forward surface by removal of material to form the cavity.

5. The invention of claim 4 wherein the aft portion of the end cap comprises a relatively strong material, the symmetrical axial hole is slightly less than 5% of the diameter of the end cap, the larger part of the cavity communicating with the hole averages about half the diameter of the forward part of the end cap and has the shape of a circular cylinder near the aft end of the larger part of the cavity communicating with the hole and the shape of a truncated cone diminishing to a diameter about one-third the diameter of the forward part of the end cap at the opening of the cavity through the forward surface of the end cap, the end cap is less than its radius in length, and the forward exterior approximately 60% of the periphery of the end cap comprises said left-hand threads mating with left-hand threads formed by the aft interior surface of the first piece of the sabot whereby acceleration of the sabot causes the sabot to spin in a direction determined by the rifling of the barrel such that the end cap is tightened as a function of angular acceleration imparted by the rifling of the barrel such that the forward surface of the end cap is fixedly bu removably coupled against the aft surface of the penetrator causing the penetrator to rotate at the same rotational velocity as the end cap during acceleration of the projectile.

* * * * *